United States Patent [19]

Rooney et al.

[11] 4,372,382

[45] Feb. 8, 1983

[54] METHOD AND SAMPLER FOR COLLECTING A NON-PRESSURIZED WELL FLUID SAMPLE

[75] Inventors: John F. Rooney; Robert G. Pindell, both of Houston, Tex.

[73] Assignee: Texaco Inc., White Plains, N.Y.

[21] Appl. No.: 216,742

[22] Filed: Dec. 15, 1980

[51] Int. Cl.[3] ..... E21B 49/08

[52] U.S. Cl. ..... 166/264; 73/864.63; 166/165; 166/64

[58] Field of Search ..... 166/264, 162, 165, 64; 175/59, 234, 235; 73/864.63, 864.65, 864.66, 864.67

[56] References Cited

U.S. PATENT DOCUMENTS

| | | | |
|---|---|---|---|
| 1,775,641 | 9/1939 | Haertl | 166/165 |
| 2,209,262 | 7/1940 | Freund | 73/864.65 |
| 2,298,627 | 10/1942 | Proudman et al. | 73/864.63 |
| 2,342,367 | 2/1944 | Pryor | 166/165 |
| 2,577,210 | 12/1951 | Ruska | 166/165 |
| 2,667,223 | 1/1954 | Farris | 166/165 |
| 2,686,566 | 8/1954 | Barnes | 166/165 |
| 2,728,397 | 12/1955 | Ruska | 166/162 X |
| 2,862,561 | 12/1958 | Teubner | 166/165 |
| 3,047,072 | 7/1962 | Peters et al. | 166/264 X |
| 3,379,065 | 4/1968 | Gibbon | 73/864.65 |
| 3,426,847 | 2/1969 | Reardon | 166/150 |
| 3,942,374 | 3/1976 | Glenn | 73/864.63 |

*Primary Examiner*—Ernest R. Purser

*Attorney, Agent, or Firm*—Jack H. Park; Theron H. Nichols

[57] ABSTRACT

A method for collecting a non-pressurized sample of fluid from a well is disclosed and an illustrative sampler for performing the method is shown comprising two elongated sampler chamber interconnected upper and lower valves wherein the upper valve is mounted externally of the chamber and has a vent therein for providing less internal fluid drag in the chamber for improved and faster purging, filling, without subjecting the fluid to high shear rates, and emptying of the sample chamber and for ensuring a non-pressurized true representation sample upon arrival at the surface.

9 Claims, 5 Drawing Figures

METHOD AND SAMPLER FOR COLLECTING A NON-PRESSURIZED WELL FLUID SAMPLE

BACKGROUND OF THE INVENTION

Very often a true, representative sample of the fluid in a well is desired but not necessarily obtained. A current problem in secondary oil recovery, for example, is the need for a sample of the injected polymer in an injection well at the depth of the intended injection interval. After this polymer has entered the formation and backflowed thereafter, it must be sampled without having its physical properties altered as it is lifted to the surface for analyzing and testing. An additional example is the need to sample polymer which has flowed through the oil bearing formation from the injection well to the producing well. This sample must also be obtained and lifted to the surface without altering its physical properties.

Various problems arise in obtaining the sample of the well fluid. First, the injection well fluid or polymer is stagnant and so the polymer must be made to flow into the sampler. Second, and most importantly, most polymers cannot be subjected to high shear rates which occur during high flow rates. Conventional bottom hole samplers enter the well with the sample chamber at atmospheric pressure and when opened in the wellbore at the formation depth will rapidly fill exposing the sample to very high shear rates. The high shear rates particularly alter the physical properties of the polymer and accordingly produce a non-representative sample. The method and sampler disclosed herein provide a true and representative sample from the perforated interval, for example.

OBJECTS OF THE INVENTION

A primary object of this invention is to provide a method of collecting a non-pressurized sample of fluid from a well without changing its physical properties for providing a true, representative well fluid sample.

Another primary object of this invention is to provide a well fluid sampler that will carry out the above method.

A still further object of this invention is to provide a well fluid sampler that has the upper valve mounted externally of the sampler chamber for providing less internal fluid drag in the chamber for improved and faster purging, filling, and emptying of the sample chamber.

Another object of this invention is to provide a sampler with vent means in its upper valve for equalizing the pressure in the closed sampler chamber with that above the sampler for ensuring a non-pressurized sample upon arrival at the surface.

A further object of this invention is to provide a well fluid sampler for collecting a non-pressurized representative sample that is easy to operate, is of simple configuration, is economical to build and assemble, and is of greater efficiency for the collection of samples of such well fluid.

Other objects and various advantages of the disclosed sampler and method for collecting a true representative sample will be apparent from the following detailed description, together with the accompanying drawing, submitted for purposes of illustration only and not intended to define the scope of the invention, reference being made for that purpose to the subjoined claims.

BRIEF DESCRIPTION OF THE DRAWING

The drawing diagrammatically illustrates by way of example, not by way of limitation, one form of the invention wherein like reference numerals designate corresponding parts in the several views in which.

The invention disclosed herein, the scope of which being defined in the appended claims is not limited in its application to the method steps disclosed herein or to the details of construction and arrangement of parts shown and described, since the invention is capable of being in the form of other embodiments and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE INVENTIONS

This patent includes two inventions, a method for collecting a non-pressurized sample of fluid from a well that is a true, representative well fluid sample, and a mechanism for practicing the above method.

METHOD FOR COLLECTING A NON-PRESSURIZED FLUID FROM A WELL

Figure 1A:
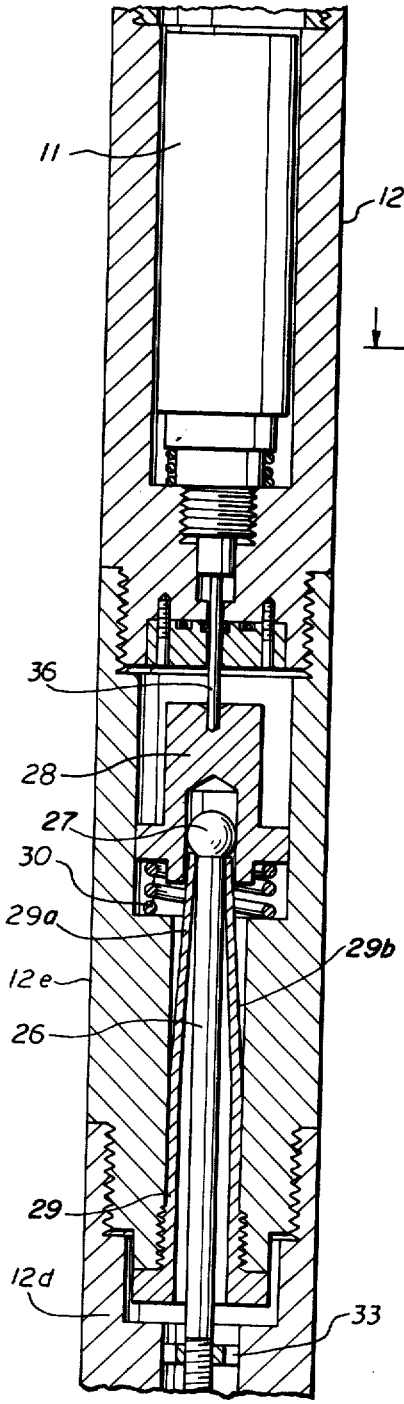
FIG. 1A is a schematic diagrammatic vertical sectional view of the upper portion of the new fluid sampler with the two valves in open position.
Figure 1B:
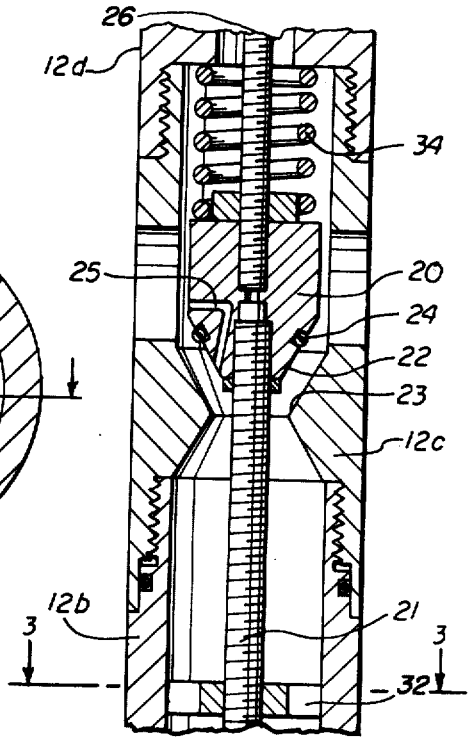
FIG. 1B is a schematic diagrammatic vertical sectional view of the lower portion of the sampler of FIG. 1A taken at the section line indicated on FIG. 3 with both valves open.

The basic method for collecting a non-pressurized sample of well fluid in a sampler sample chamber (16), FIG. 1B, having interconnected upper and lower valves (20, 17) in upper and lower ends of the sample chamber (16) comprises the steps of, (1) actuating upwardly both upper (20) and lower (17) valves of the sampling chamber (16) for opening and ease of purging of the sample chamber with submerging of the chamber in the well, and (2) actuating downwardly both upper (20) and lower (17) valves simultaneously for closing said valves and sealing a true, representative sample of fluid in the sample chamber (16) for recovery at the surface.

The above first method step may include the following details:

(1) actuating the upper valve (20) at the surface to both closed and open positions totally externally of the sample chamber (16) for providing least internal fluid drag in the sample chamber for improved and faster purging, filling and emptying of the sample chamber for obtaining a true, representative sample of the well fluid.

Another detailed method step of the last step of the above basic method may comprise, (1) venting (25) the closed sample chamber (16) for equalizing the pressure in the closed sample chamber with that adjacent the sampler for ensuring a non-pressurized sample upon arrival at the surface.

The basic method may be recited in greater detail thus, (1) actuating both of the upper (20) and lower (17) valves down into conical valve seats (23, 15), respectively for closing both valves and actuating both valves upwardly out of the valve seats for opening both valves for providing improved and faster purging, filling, and emptying of the sample chamber.

THE PREFERRED EMBODIMENT FOR PRACTICING THE INVENTION SAMPLER FOR COLLECTING A WELL FLUID SAMPLE

Figure 3:
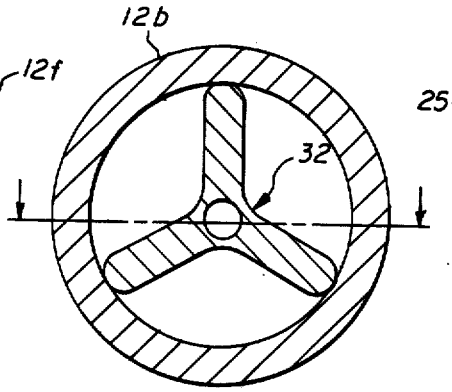
FIG. 3 is a section taken at 3—3 on FIG. 1B.

The above methods for collecting a non-pressurized sample of fluid from a well in a sampler sample chamber may be performed by other mechanisms than that disclosed in the FIGURES. The mechanism disclosed herein may be operated by other methods than those disclosed, as by hand. Also the disclosed mechanism can be used to practice another and materially different method. However, the preferred system for performing the method is disclosed in FIGS. 1–3.

FIG. 1B illustrates the sampler 10 being cocked into open position and held in that position by a latching mechanism and a clock 11 mounted on the upper end of the sampler as viewed in FIG. 1A.

Sampler 10, FIGS. 1A–1B, includes a housing 12 comprising several cylinders housing sections 12*a*, 12*b*, 12*c*, 12*d*, 12*e*, 12*f*, and 12*g* screw threaded to each other extending from the bottom or lower end of the sampler to the upper end of the sampler. A sample removal cap 13 FIG. 1B is only secured to the housing nose or housing lower end section 12*a* with wing nut screws, 14*a*, 14*b*, after the sampler is raised to the surface and readied for emptying. Also a concave conical valve seat 15 is formed on the upper end of the housing lower end section 12*a* for forming the lower end of an elongated sample holding chamber 16 in the greater portion of the sampler 10 and enclosed in housing section 12*b*.

A lower valve 17, FIG. 1B, has a convex conical surface 18 for matching or fitting in valve concave conical seat 15 fluid tight when closed for sealing closed the lower end of sample chamber 16. O-ring 19 ensures a fluid tight seal in the valve 17.

An upper valve 20, FIG. 1B, is interconnected to lower valve 17 with adjusting rod 21. Valve 20 is positioned externally of and above the chamber 16 and has convex conical surface 22 for fitting in concave conical valve seat 23 in housing section 12*c*. O-ring 24 on valve surface 22 ensures a fluid tight seal when the upper valve 20, which is externally positioned from the sample chamber 16 is set in the chamber external upper convex conical valve seat 23. An important feature of this fluid sampler is the positioning of the upper valve 20 and its valve seat 23 on the outside of the sample holding chamber for providing a clean exit flow passage for the sample fluid for decreasing shear of the fluid as it flows therethrough.

Figure 2A:
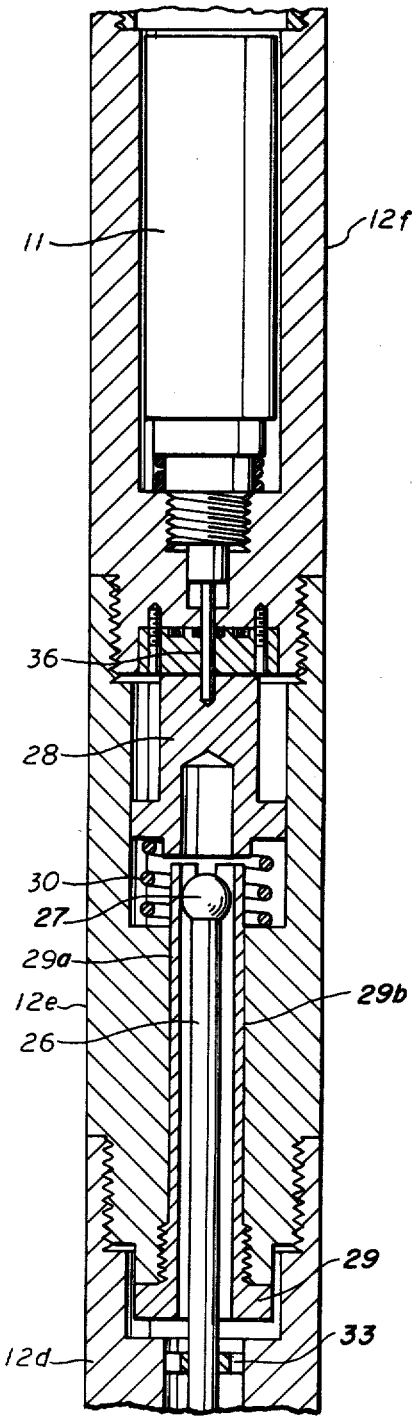
FIG. 2A is a schematic diagrammatic vertical sectional view of the upper portion of the sampler of FIGS. 1A and 1B but with the two valves closed for raising a sampler full of well fluid.
Figure 2B:
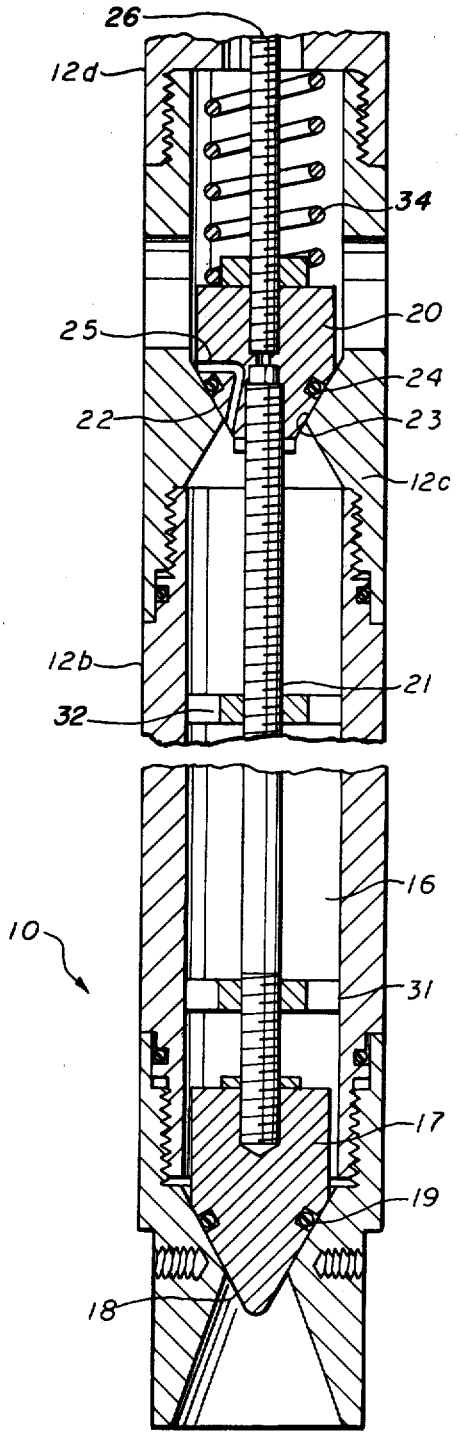
FIG. 2B is a schematic diagrammatic vertical sectional view of the lower portion of the sampler of FIG. 2A; taken at the section line on FIG. 3 with both valves closed.

Another important structural feature of this invention are pressure vent passages 25 in the end of upper valve 20 for maintaining the pressure in the sample chamber 16 equal to that outside of the fluid sampler 10 by utilization of the elongated vertical portion of vent passage 25 illustrated on FIGS. 1B and 2B.

A latching mechanism for releasably restraining the interconnected valves in the open position comprises a latch rod 26, FIG. 1A, ball 27 on end of the rod 26, sheath 28, slitted circular spring 29, latch release spring 30, the conventional clock 11 in housing cylindrical portion 12*f*, and a clock plunger 36, all in the housing section 12*e*. The elongated latch rod 26 has its lower end firmly secured on top of upper valve 20, FIG. 1B, as with screw threads and the upper end with a ball 27, FIG. 1A, formed thereon protruding slideably into hollow sheath 28. The lower circular slitted end of the circular spring 29 is fixedly secured to the lower end of housing section 12*e* as with screw threads, and the upper end of the split circular spring 29 comprises four arcuate springs 29*a* 29*b*, 29*c*, and 29*d*, *only springs 29a* and 29*b* being illustrated in FIGS. 1A and 2A, for example, with their four ends held in contiguous position relative to each other around the latch rod and against the ball 27, FIG. 1A, by the cylindrical walls of the hollow sheath 28 therearound. The latch rod 26 with valves 17, 20, attached thereto are prevented from moving downwardly due to the ball 27 abutting up against the four split ends of the circular spring 29 until the sheath 28 is moved upwardly, freeing the four split spring ends 29 and allowing the ball to spread the four split spring ends, only ends 29*a* and 29*b* being illustrated in FIGS. 1A and 2A, so the latch rod 26 can move downwardly by actuation of the clock 11 and its plunger 36.

Three support guides 31, 32, FIGS. 1A and 1B, and FIGS. 2A and 2B, have three legs each for efficiently supporting the valve adjusting rod axially of the housing sections 12*b*–12*d* and internally of the sample chamber for permitting fluid to flow freely through the sampler without causing high shear forces in the fluid, which forces are detrimental to the composition of the fluid, such as an injected polymer in an injection well for secondary oil recovery. The third guide 33, FIGS. 1A and 2A, supports the latch rod 26 centrally of the hollow housing section 12*d*.

FIG. 1B illustrates further a compression spring 34 coiled around the latch rod 26 and positioned between the top of upper valve 20 in the housing section 12*c* and the lower end of adjacent housing section 12*d* for exerting a substantial valve closing force on adjusting rod 21 for urging the valves closed. Another, but possibly weaker compression spring 30, FIG. 1A, in housing section 12*e* is coiled around the ball end of latch rod 26 and positioned between the upper end of the housing section 12*e* and the lower end of sheath 28 for urging the sheath upwardly to release the ends of latching slitted circular spring 29.

Clock 11, when set, exerts a downward force on the sheath 28 against the forces of latch release spring 30 to maintain the latch rod locked in the upward or valve open position. Upon actuation or release of the clock, the latching mechanism sheath 28 is allowed to snap upwardly by action of compression spring 30 to release slitted circular springs 29*a*–29*d* to permit the ball 27 to snap downwardly under the strong forces of a second compression spring 34 to accordingly snap the valves 17 and 20 closed.

Briefly in operation when a non-pressurized sample of well fluid, or the like, is desired, the clock 11 is set to close the two piston valves, 17, 20, on the sample chamber 11 in the fluid sampler 10 at a predetermined time.

The fluid sampler is then lowered to the desired depth on a single line with no extra wire-lines necessary to trip the latch release mechanism, to close the valves, etc. With a few up and down movements of the sampler at the desired depth, it is well purged and will trap a good sample of fluid at the moment of simultaneous closing of both valves by the clock without the sample being subjected to high shear rates. The sampler is then raised, the sample removal cap attached, the pure representative non-pressurized fluid sample drained, and then the sample removal cap removed in preparation for lowering the sample for another fluid sample.

In greater detail, the adjusting rod 21 is moved upwardly to the position illustrated in FIGS. 1A and 1B, compressing spring 34, opening both valves wide open, and protruding the ball 27 through the slitted circular spring 29. The sheath 28 is then pushed downwardly over the ball and ends of the slitted circular spring, compressing smaller spring 30 to clamp the spring ends snugly around the latch rod 26, and setting the clock 11 to maintain the sheath pushed down against the compression spring with plunger 36 until the predetermined valve closing time set in the clock.

The sampler is then lowered to the predetermined depth, raised and lowered a few times to purge the chamber of all fluids at the predetermined depth prior to actuation of the clock. When the clock releases downward pressure on the sheath 28, FIG. 2A through its plunger 36, latch release compression spring 30 raises the sheath to release the ball 27 so that compression spring 34, FIG. 2B snaps the adjusting rod 21 and two valves, 17 and 20, downwardly to closed position. With the well fluid trapped in the chamber 16, the fluid sampler is raised to the surface.

A main and another novel feature is the vent 25 in upper valve 20 for venting of any pressure differential between the fluid pressure in the chamber and that outside the sampler. This provides a non-pressurized fluid sample at the surface. The smooth internal surface of the chamber causes the shearing forces to be reduced. The sample removal cap 13 is attached by being pushed on, and then by setting the set screws, **14*a* and 14*b*. As it is pushed on the first or nose housing section 12*a*, its plunger 37 contacts and raises and opens valve 17, and likewise upper valve 20 is opened simultaneously due to rigid valve interconnecting adjusting rod 21 for causing the sample removal cap to receive the sample fluid for discharging through its valve 38**.

Figure 1B:
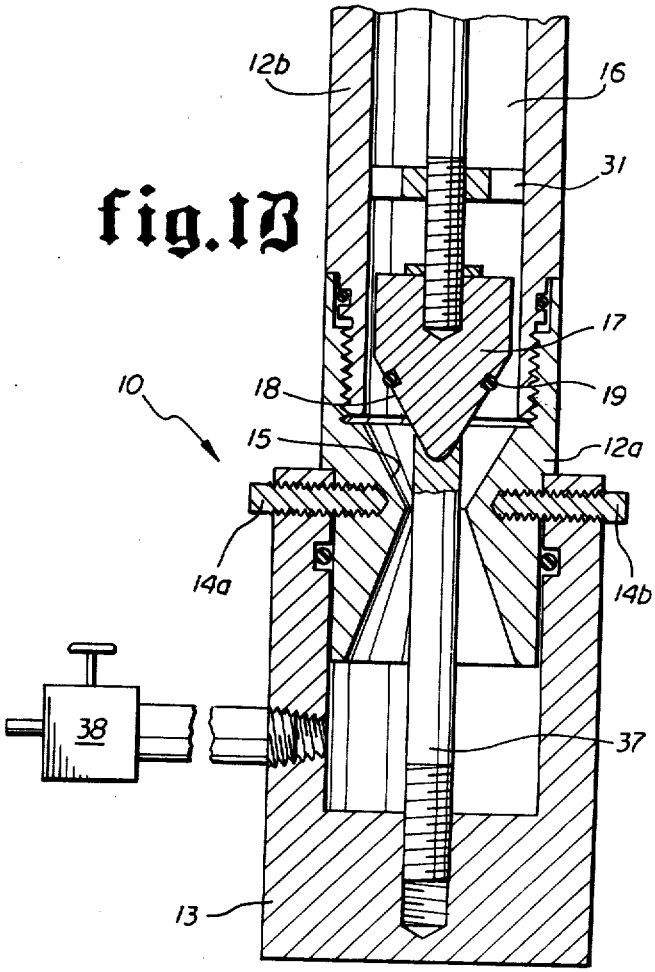

Another novel feature is the set of one or more support guides 31 and 32, FIG. 1, internally of chamber 16 for centering the adjusting rod 21 in the chamber 16 and yet causing a minimum of fluid resistance internally of the chamber.

Still another feature of the disclosed fluid sampler is the positioning of the upper valve 20 externally of the chamber for creating much less fluid flow drag or resistance. Also, this reduces the shear effect in the well fluid.

Obviously other methods may be utilized for collecting a non-pressurized sample of fluid from a well than those listed above, depending on the particular fluid desired to be sampled.

Accordingly, it will be seen that the disclosed method for collecting a well fluid sample and the disclosed fluid sampler will operate in a manner which meets each of the objects set forth hereinbefore.

While only one method of the invention and one mechanism for carrying out the method have been disclosed, it will be evident that various other methods and modifications are possible in the arrangement and construction of the disclosed methods and sampler for collecting well fluid samples without departing from the scope of the invention and it is accordingly desired to comprehend within the purview of this invention such modifications as may be considered to fall within the scope of the appended claims.

We claim:

1. A method for collecting a non-pressurized sample of fluid from a well in a sampler sample chamber having interconnected upper and lower valves in upper and lower ends of the same chamber to permit the pressure in the sample chamber to equalize with the ambient comprising the steps of, (a) actuating upwardly both upper and lower valves of the sample chamber for opening and ease of purging of the sample chamber with submerging of the chamber in the well, and (b) venting the sample fluid through a substantially vertical portion of a vent passage from the chamber to outside the sampler upon actuating both upper and lower valves downwardly substantially simultaneously for actuating the valves and maintaining a true, representative sample of fluid in the sample chamber and to permit the pressure in the sampler to equalize with the ambient for recovery at the surface.

2. A method as recited in claim 1 wherein the last method step comprises further, (a) venting the closed sample chamber for equalizing the pressure in the closed sample chamber with that adjacent the sampler for ensuring a non-pressurized sample upon arrival at the surface.

3. A method as recited in claim 1 wherein the last method step comprises further, (a) venting the closed sample chamber around the closed upper valve for equalizing the pressure in the closed sample chamber with that adjacent the sampler for ensuring a non-pressurized sample upon arrival at the surface.

4. A method as recited in claim 1 comprising further, (a) venting the sample fluid through an elongated substantially radial portion of the vent passage subsequent to passage through the vertical portion of the vent passage upon actuating both the upper and lower valves down into conical valve seats and actuating both valves upwardly out of the valve seats for opening both valves substantially simultaneously for providing improved and faster purging, filling, and emptying of the sample chamber.

5. A non-pressurized low internal resistance subsurface sampler comprising, (a) an elongated housing means having upper and lower valve means at upper and lower ends of a sample collecting chamber therein for controlling the flow of fluid therethrough, said housing means having upper passage means between said collecting chamber and the ambient, and (b) unobstructed vent passage means in one of said valve means having a vertical portion for permitting the pressure in the sampler to equalize with the ambient for recovery at the surface.

6. A non-pressurized subsurface sampler as recited in claim 5 comprising further, (a) said vent passage means comprises an elongated substantially radial portion connected to said vertical portion for permitting the pressure in the sampler to equalize with the ambient for recovery at the surface.

7. A subsurface sampler as recited in claim 5 comprising further, (a) latching means (11, 26–30, and 36) for restraining said elongated housing means (12*e*, 12*f*) in an upper position for holding said upper (20) and lower (17) valves in open position (FIGS. 1A and 1B), and (b) said latching means comprising a plurality of arcuate springs (29A–29D) restrained from spreading apart by a sheath (28) for providing a simple, easy to operate, fool-proof latching means for restraining said valves in open position.

8. A subsurface sampler as recited in claim 7 comprising further, (a) latching means (11, 26–30 and 36) for restraining said valves in closed positions (FIGS. 2A and 2B), and (b) said latching means comprising a spring (34) for restraining said valves (17, 20) in closed position for providing a simple, easy to operate, fool-proof latching means for restraining said valves in closed position.

9. A non-pressurized subsurface, low internal resistance sampler having upper and lower valves and a longitudinal axis wherein, (a) said upper valve has an unobstructed vent means therein for equalizing the pressure in a sample chamber with the ambient, said sampler having an upper passage from the sample chamber to the ambient, and (b) said unobstructed vent means comprising a fluid passage having a vertical portion substantially parallel to the longitudinal axis of said sampler and a radial portion substantially normal to the vertical portion for passage of sample fluid from the sampler to the well externally of the sampler for permitting fluid pressure in the sampler to equalize with the ambient for recovery at the surface.

* * * * *